US006544006B2

(12) United States Patent
Yokomachi et al.

(10) Patent No.: US 6,544,006 B2
(45) Date of Patent: Apr. 8, 2003

(54) PISTON TYPE COMPRESSOR

(75) Inventors: Naoya Yokomachi, Kariya (JP); Tatsuya Koide, Kariya (JP); Masakazu Murase, Kariya (JP); Yoshio Taneda, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/952,660

(22) Filed: Sep. 14, 2001

(65) Prior Publication Data

US 2002/0044872 A1 Apr. 18, 2002

(30) Foreign Application Priority Data

Oct. 5, 2000 (JP) ..... 2000-306181

(51) Int. Cl.[7] ..... F04B 27/08
(52) U.S. Cl. ..... 417/269; 277/608
(58) Field of Search ..... 417/269, 222.2; 91/409, 504; 92/71; 277/608

(56) References Cited

U.S. PATENT DOCUMENTS 6,092,996 A 7/2000 Obrist et al.
6,109,883 A * 8/2000 Kawaguchi et al. ..... 417/269
6,322,086 B1 * 11/2001 Yokomachi et al. ..... 277/608

* cited by examiner

*Primary Examiner*—Teresa Walberg
*Assistant Examiner*—Vinod D Patel
(74) *Attorney, Agent, or Firm*—Woodcock Washburn LLP

(57) ABSTRACT

A gasket 36 is interposed between an end face 341 of a front housing 11 and an end face 351 of a rear housing 12. A coned disc spring 37 is interposed between an end face 192 of a cylinder 19 and the end face 341 of the front housing 11. When the end faces 341, 351 are caused to approach each other so as to be joined together, the coned disc spring 37 is first held by the end face 341 of the front housing 11 and the end face 192 of the cylinder 19. When the end faces 341, 351 are caused to approach each other further so as to be joined together, the gasket 36 is held between the end faces 341, 351.

Thus, it is ensured that the cylinder and the seal material interposed between the first housing and the second housing are held therebetween.

5 Claims, 8 Drawing Sheets

PISTON TYPE COMPRESSOR

BACKGROUND OF THE INVENTION

1. Field of the Invention

The present invention relates to a piston type compressor in which pistons are accommodated in cylinder bores formed in a cylinder, in which the pistons are reciprocated through rotation of a rotating shaft so that gas is sucked into and is discharged from the cylinder bores through reciprocating motion of the pistons, and in which the cylinder is incorporated in a total housing constructed by joining a first housing and a second housing together.

2. Description of the Related Art

A piston type the compressor is disclosed in, for example, Japanese Patent Unexamined Publication (Kokai) No. 10-306773 in which a cylinder is incorporated in a total housing constructed by joining a first housing and a second housing together. The construction in which the cylinder is incorporated in the total housing is a measure for keeping a joint between the first housing and the cylinder and a joint between the cylinder and the second housing unexposed to the outside of the compressor. Keeping the joints unexposed to the outside of the compressor is effective in reducing the possibility that refrigerant inside the compressor will leak therefrom.

A seal material is interposed at a joint between the first housing and the second housing. The seal material held by the first housing and the second housing therebetween prevents the leakage of refrigerant from the joint between the first housing and the second housing.

In order to produce no looseness of the cylinder in directions in which the pistons reciprocate, in the apparatus disclosed in the Japanese Patent Unexamined Publication (Kokai) No. 10-306773, a construction is adopted in which the cylinder and a valve plate are both held by the first housing and the second housing therebetween. Consequently, the first and second housings must hold the seal material and the cylinder between them. However, it is difficult to ensure that both the seal material and the cylinder are so held, due to dimensional and assembling errors of components of the compressor. If the seal material is not held in an ensured fashion, refrigerant leaks from the joint between the first housing and the second housing. If the cylinder is not held in an ensured fashion, looseness of the cylinder occurs. While looseness of the cylinder can be prevented by press fitting the cylinder in the total housing, press fitting results in deformation of the cylinder, and the deformation of the cylinder results in deformation of cylinder bores formed in the cylinder, this facilitating the leakage of refrigerant contained inside the cylinder bores past the circumferential surfaces of the pistons accommodated in the cylinder bores.

SUMMARY OF THE INVENTION

An object of the present invention is to ensure that a cylinder incorporated in a total housing constituted by a first housing and a second housing, and a seal material interposed between the first housing and the second housing are held between the first housing and the second housing.

To this end, according to an aspect of the present invention, there is provided a piston type compressor in which pistons are accommodated in cylinder bores formed in a cylinder, in which the pistons are reciprocated through rotation of a rotating shaft so that gas is sucked into and is discharged from the cylinder bores through reciprocating motion of the pistons, and in which the cylinder is incorporated in a total housing constructed by joining a first housing and a second housing together, the piston type compressor comprising a seal material provided at a joint between the first housing and the second housing so as to be held by the first housing and the second housing therebetween, and a gap absorbing body interposed between at least one of the first housing and the second housing and the cylinder, wherein in a state in which the seal material is held by the first housing and the second housing therebetween, the gap absorbing body is deformed by the first housing and the second housing so that the cylinder and the gap absorbing body are both held therebetween.

When the first housing and the second housing are caused to approach each other so as to be joined together, the gap absorbing body and the cylinder are first held by the first housing and the second housing. When the first housing and the second housing are caused to approach further so as to be joined together, the gap absorbing body is deformed to contract, and as the gap absorbing body contracts, the seal material comes to be held by the first housing and the second housing. Consequently, it is ensured that the seal material and the cylinder are held by the first housing and the second housing therebetween.

According to another aspect of the present invention, the gap absorbing body comprises an elastic body.

When the first housing and the second housing are caused to approach each other so as to be joined together, the elastic body held by the first housing and the second housing therebetween contracts while being elastically deformed.

According to a further aspect of the present invention, the gap absorbing body is formed of a soft metal, which is easy to deform.

According to a yet further aspect of the present invention, the gap absorbing body comprises a deformable projection integrally formed on at least one of the first housing and the second housing.

When the first housing and the second housing are caused to approach each other so as to be joined together, the projection contracts while being deformed.

According to a further aspect of the present invention, the gap absorbing body comprises a gap absorbing ring which conforms to the annular contour of the joint which surrounds the rotating axis of the rotating shaft.

The gap absorbing ring which conforms to the annular contour of the joint is suitable as a gap absorbing body in providing a uniform press contact between the seal material and the first housing, as well as between the seal material and the second housing.

The present invention may be more fully understood from the description of preferred embodiments of the invention set forth below, together with the accompanying drawings.

DESCRIPTION OF THE PREFERRED EMBODIMENTS

Referring to FIGS. 1 to 4, a first embodiment will be described below in which the present invention is applied to a variable displacement type compressor. In this embodiment, carbon dioxide is used as the refrigerant.

Figure 1:
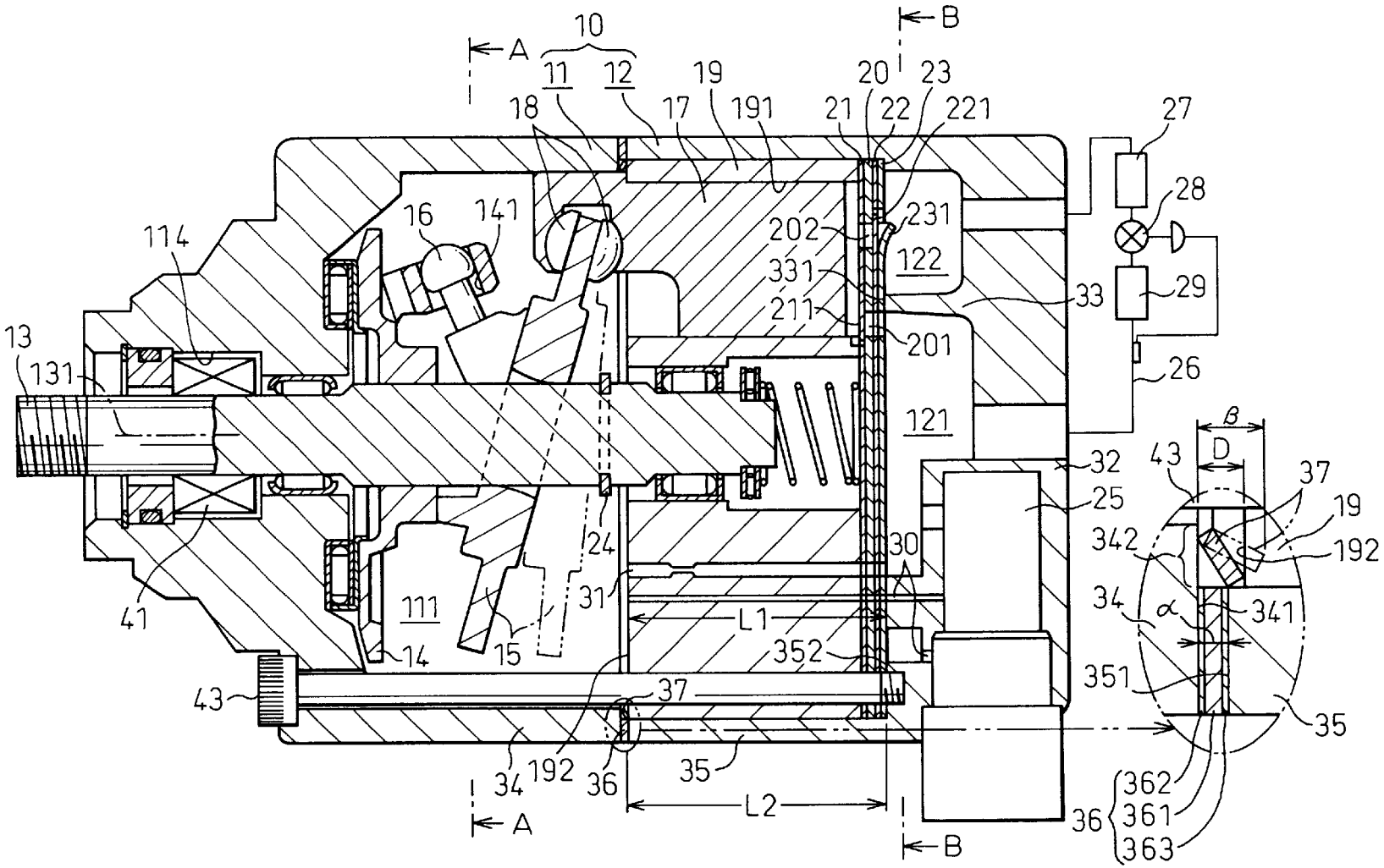
FIG. 1, showing a first embodiment of the present invention, is a cross-sectional side view of the entirety of a compressor with an enlarged cross-sectional side view of a main part of the compressor being incorporated therein.

As shown in FIG. 1, an end face 341 of a circumferential wall 34 of a front housing 11 and an end face 351 of a circumferential wall 35 of a rear housing 12 are joined to each other via a gasket 36. The front housing 11, which is a first housing, and the rear housing 12, which is a second housing, are fixed to each other with tightened bolts 43 to thereby constitute a total housing 10. The gasket 36 comprises a ring-like substrate 361 and rubber elastic layers 362, 363 which are baked to sides of the substrate 361. The elastic layer 362 is joined to the end face 341 of the front housing 11, while the elastic layer 363 is joined to the end face 351 of the rear housing 12.

Fitted in the rear housing 12 are a valve plate 20, valve forming plates 21, 22 and a retainer forming plate 23, and a portion between the valve plate 20 and an end wall 32 of the rear housing 12 is sectioned off into a suction chamber 121 and a discharge chamber 122. The suction chamber 121 and the discharge chamber 122 are separated from each other by a partition 33. A distal end face 331 of the partition 33 abuts against the retainer forming plate 23, and an outer circumferential edge of the retainer forming plate 23 is joined to a difference in level 352 formed on an inner circumference of the circumferential wall 35 of the rear housing 12.

A cylinder 19 is fitted in the rear housing 12 in such a manner as to be joined to the valve forming plate 21. A rotating shaft 13 is rotatably supported on the front housing 11 and the cylinder 19 which constitute a pressure control chamber 111. The rotating shaft 13 protruding to the outside of the compressor through a shaft hole 114 in the front housing 11 is adapted to obtain rotational driving force from an external driving source (for example, an engine of a vehicle). A shaft sealing member 41 provided in the shaft hole 114 prevents the leakage of refrigerant from the pressure control chamber 111 past the circumferential surface of the rotating shaft 13.

Figure 2:
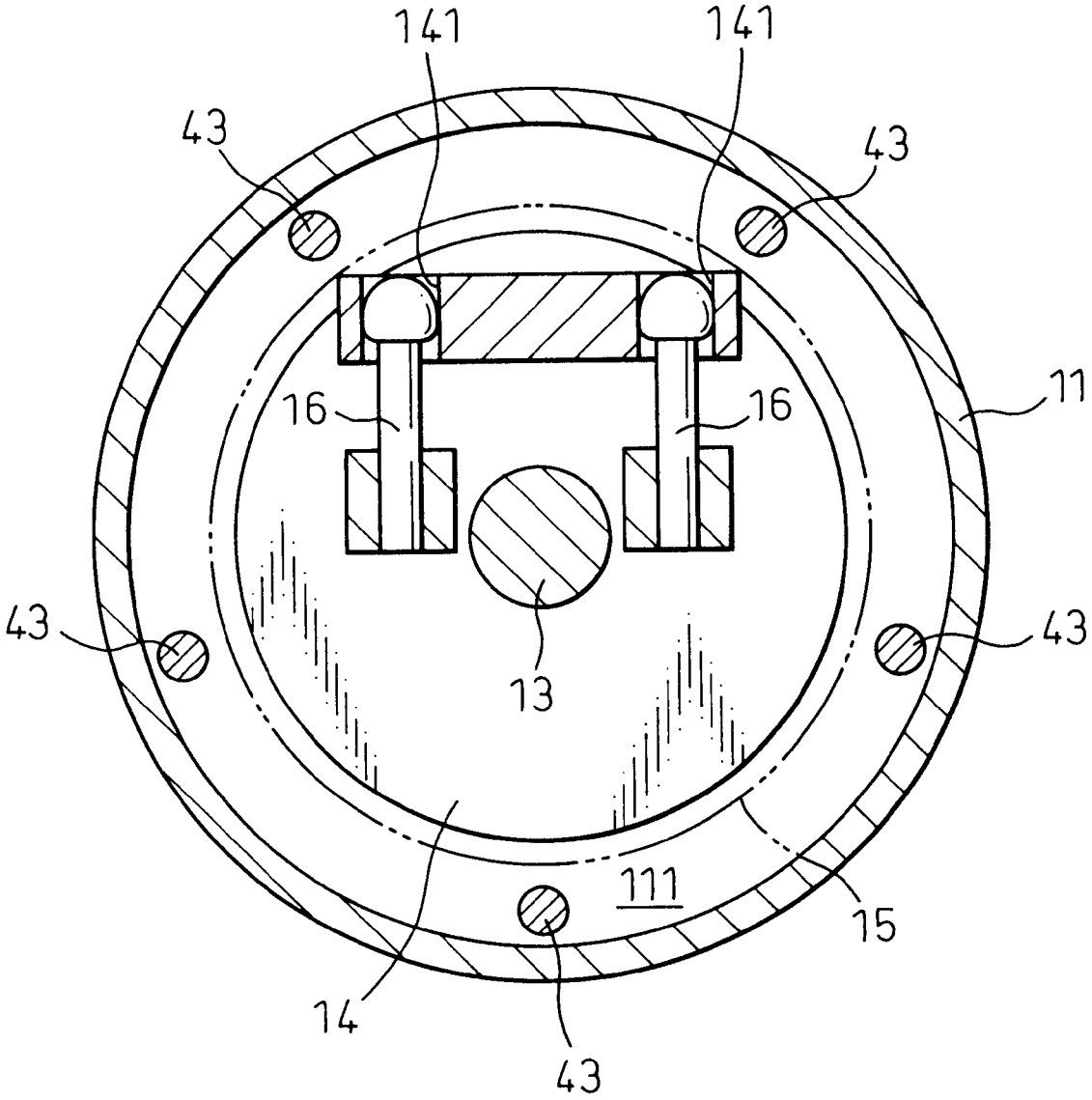
FIG. 2 is a cross-sectional view taken along the line A—A in FIG. 1.

A rotary support body 14 is securely fastened to the rotating shaft 13, and a swash plate 15 is supported on the rotating shaft 13 sildably in an axial direction and tiltably. As shown in FIG. 2, a pair of guide pins 16 are securely fastened to the swash plate 15. The guide pins 16 so securely fastened to the swash plate 15 are fitted in guide holes 141 formed in the rotary support body 14, respectively. The swash plate 15 can tilt in the axial direction of the rotating shaft 13 and rotate together with the rotating shaft 13 through the linkage of the guide holes 141 and the guide pins 16. Tilting of the swash plate 15 is guided by the slide guide relationship between the guide holes 141 and the guide pins 16, as well as by the slide support operation of the rotating shaft 13.

Figure 3:
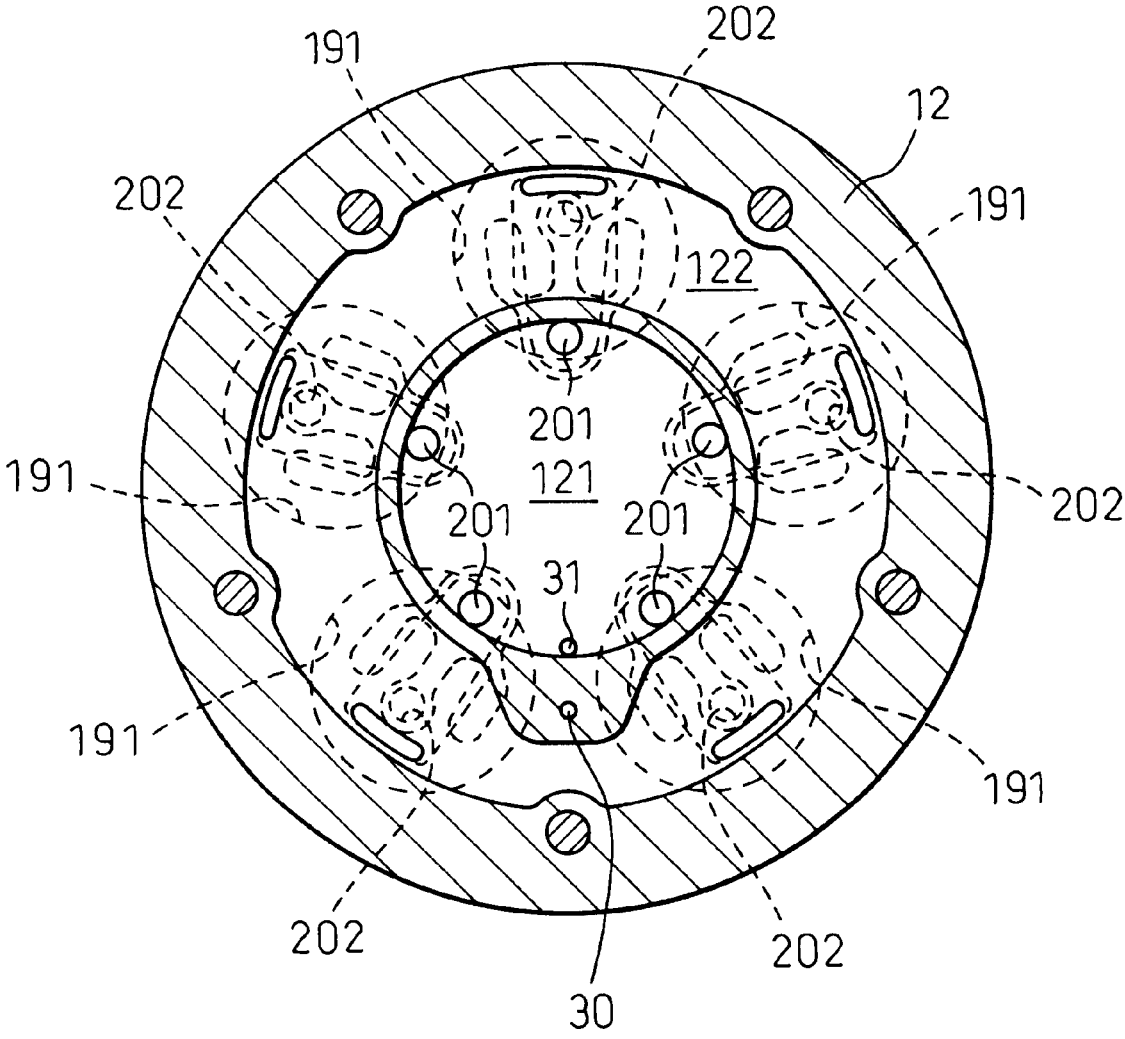
FIG. 3 is a cross-sectional view taken along the line B—B in FIG. 1.
Figure 4:
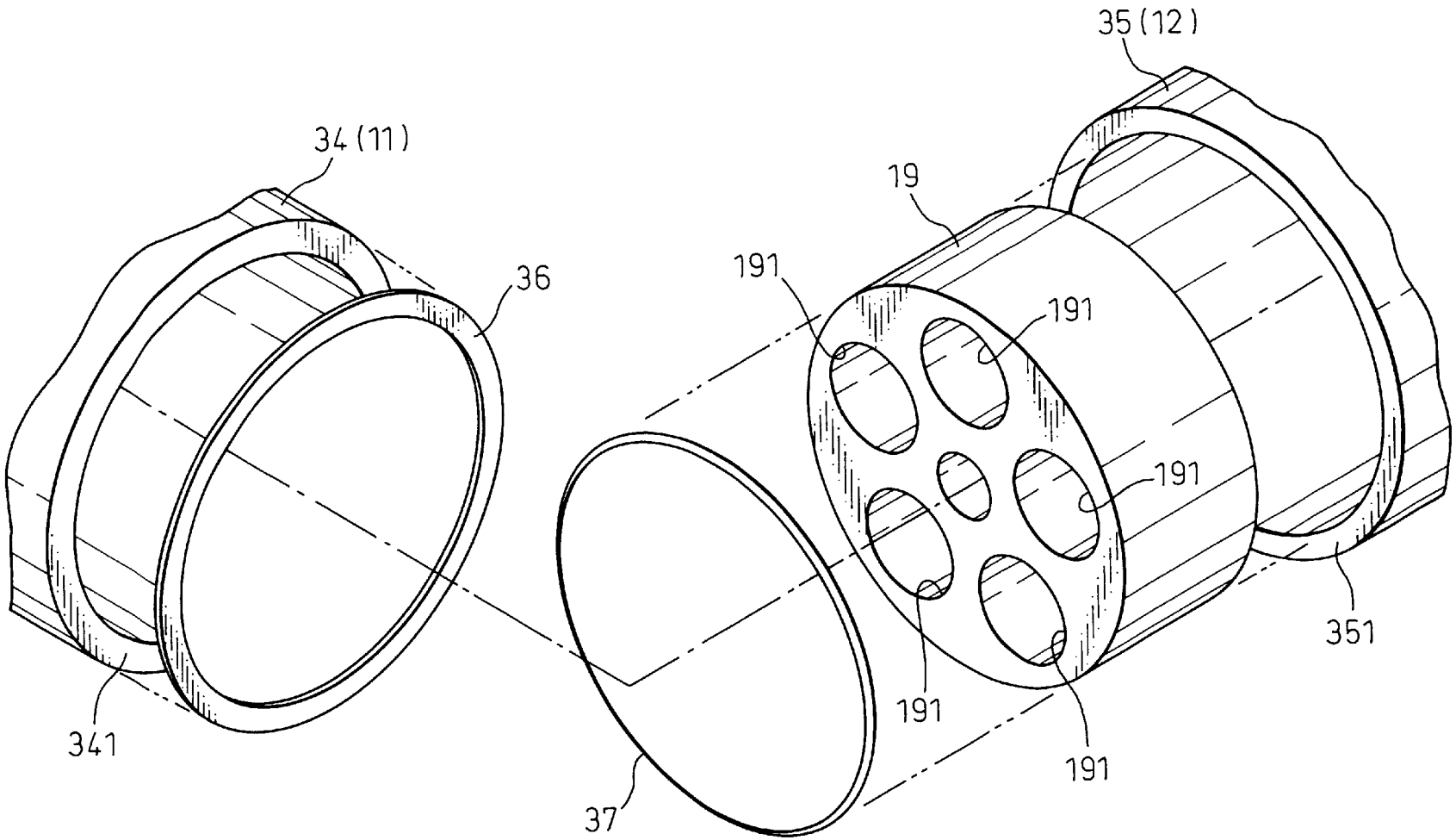
FIG. 4 is an exploded perspective view of the compressor according to the first embodiment, FIG. 5, showing a second embodiment of the present invention, is a cross-sectional side view of the entirety of a compressor with an enlarged cross-sectional side view of a main part of the compressor being incorporated therein.

As shown in FIG. 1, a plurality of cylinder bores 191 (while only one cylinder bore is shown in FIG. 1, in this embodiment, there are formed five cylinder bores as shown in FIGS. 3 and 4) are formed in the cylinder 19 so as to be arranged around the rotating shaft 13. Pistons 17 are accommodated in the cylinder bores 191, respectively. The rotary motion of the swash plate 15 which rotates together with the rotating shaft 13 is transformed into the reciprocating motion of the pistons 17 via shoes 18, whereby the pistons 17 reciprocate in the cylinder bores 191, respectively.

As the piston 17 moves backward (a movement from the right-hand side to the left-hand side as viewed in FIG. 1), the refrigerant in the suction chamber 121 which constitutes a suction pressure area flows in from a suction port 201 in the valve plate 20 to displace a suction valve 211 on the valve forming plate 21 and then into the cylinder bore 191. As the piston 17 moves forward (a movement from the left-hand side to the right-hand side as viewed in FIG. 1), the refrigerant that has flowed into the cylinder bore 191 flows out from a discharge port 202 in the valve plate 20 to displace a discharge valve 221 on the valve forming plate 22 and is discharged into the discharge chamber 122 which constitutes a discharge pressure area. The discharge valve 221 is brought into abutment with a retainer 231 on the retainer forming plate 23, whereby the opening of the discharge valve 221 is restricted.

A pressure supply passage 30 connecting the discharge chamber 122 with the pressure control chamber 111 sends the refrigerant in the discharge chamber 122 to the pressure control chamber 111. The refrigerant in the pressure control chamber 111 flows out into the suction chamber 121 via a pressure release passage 31. An electromagnetic capacity control valve 25 is provided in the pressure supply passage 30. The capacity control valve 25 is controlled by a controller (not shown) so as to be excited or de-excited. The controller controls the capacity control valve 25 such that the capacity control valve 25 is excited or de-excited based on a detected room temperature which is obtained by a room temperature detector (not shown) for detecting the temperature of the passenger compartment of the vehicle and a target room temperature which is set by a room temperature setting device (not shown). The capacity control valve 25 is open when it is not energized, while the capacity control valve 25 is closed when it is energized. Namely, when the capacity control valve 25 is de-excited, the refrigerant in the discharge chamber 122 is sent to the pressure control chamber 111, while when the capacity control valve 25 is excited, in no case is the refrigerant in the discharge chamber 122 sent to the pressure control chamber 111. The capacity control valve 25 controls the supply of refrigerant from the discharge chamber 122 to the pressure control chamber 111.

The inclination angle of the swash plate 15 varies based on pressure control implemented in the pressure control chamber 111. As the pressure in the pressure control chamber 111 increases, the inclination angle of the swash plate 15 decreases, while as the pressure in the pressure control chamber 111 decreases, the inclination angle of the swash plate 15 increases. When the refrigerant is supplied from the discharge chamber 122 to the pressure control chamber 111, the pressure in the pressure control chamber 111 increases, while when the supply of the refrigerant from the discharge chamber 122 to the pressure control chamber 111 is stopped, the pressure in the pressure control chamber 111 decreases. Namely, the inclination angle of the swash plate 15 is controlled by the capacity control valve 25.

The maximum inclination angle of the swash plate 15 is restricted by virtue of the abutment of the swash plate 15 against the rotary support body 14. The minimum inclination angle of the swash plate 15 is restricted by virtue of the abutment of a snap ring 24 on the rotating shaft 13 against the swash plate 15.

The discharge chamber 122 and the suction chamber 121 are connected to each other via an external refrigerant circuit 26. The refrigerant which flows out from the discharge chamber 122 to the external refrigerant circuit 26 is returned to the suction chamber 121 by way of a condenser 27, an expansion valve 28 and an evaporator 29.

An end face 192 of the cylinder 19 which faces the pressure control chamber 111 is located more inwardly of the rear housing 12 than the end face 351 of the circumferential wall 35 of the rear housing 12. The thickness of the circumferential wall 34 of the front housing 11 is greater than the thickness of the circumferential wall 35 of the rear housing 12, and the diameter of the inner circumference of the circumferential wall 34 of the front housing 11 is smaller than the diameter of the inner circumference of the circumferential wall 35 of the rear housing 12. Consequently, a difference in level 342 is produced on the inner circumference sides of the circumferential walls 34, 35 between the end face 192 of the cylinder 19 and the end face 341 of the circumferential wall 34 of the front housing 11. A coned disc spring 37 is interposed between the end face 192 of the cylinder 19 and the difference in level 342.

A sum L1 of the thicknesses of the valve plate 20, the valve forming plates 21, 22 and the retainer forming plate 23 and the length of the cylinder 19 is less than a distance L2 between a difference in level 352 on the circumferential wall 35 of the rear housing 12 and the end face 351 thereof. Assume that the thickness of the gasket 36 is $\alpha$ when the gasket 36 is held between the end face 341 of the front housing 11 and the end face 351 of the rear housing 12. A gap D formed between the end face 192 and the difference in level 342 when the gasket 36 is held between the end face 341 of the front housing 11 and the end face 351 of the rear housing 12 is expressed as $(L2-L1)+\alpha$. The thickness $\beta$ of the coned disc spring 37 when it is in its natural condition (indicated by chain lines as shown in FIG. 1) is greater than the gap D.

The first embodiment provides the following advantages.

(1) When the end face 341 of the circumferential wall 34 of the front housing 11 and the end face 351 of the circumferential wall 35 of the rear housing 12 are caused to approach each other so as to be joined together, the coned disc spring 37 is first held by the end face 341 of the front housing 11 and the end face 192 of the cylinder 192. When the end faces 341, 351 are caused to approach each other further, the coned disc spring 37 is elastically deformed to contract in thickness, and as the coned disc spring 37 so contracts, the gasket 36 is held between the end faces 341, 351. Consequently, the gasket 36, which is a seal material, and the cylinder 19 are both held by the front housing and the rear housing in an ensured fashion.

(2) A reaction force generated by the elastic deformation of the coned disc spring 37 serves to eliminate looseness of the cylinder 19 between the front housing 11 and the rear housing 12.

(3) In the case where the press contact between the gasket 36 and the front housing 11 or press contact between the gasket 36 and the rear housing 12 becomes insufficient even at one position along the circumferential direction, refrigerant can easily leak through that position. The end face 341 of the front housing 11 and the end face 351 of the rear housing 12 constitutes the annular joint which surrounds the rotating axis 131 (illustrated in FIG. 1) of the rotating shaft 13. The coned disc spring 37 which conforms to the annular contours of the end faces 341, 351 constituting the joint provides a uniform press contact between the gasket 36 and the front housing 12, as well as a uniform press contact between the gasket 36 and the rear housing 12 along the full circumferences of the end faces 341, 351, respectively. The uniform press contacts so formed are crucial in preventing leakage of refrigerant from the joint between the front housing 11 and the rear housing 12.

(4) Carbon dioxide refrigerant is used in a more highly pressurized condition than chlorofluorocarbons refrigerant. The higher the pressure of the refrigerant, the more easily it leaks from the joint between the front housing 11 and the rear housing 12. Due to this, ensuring that the gasket 36 is brought into press contact with the front housing 11, as well as the rear housing 12, is extremely important in the case of a compressor utilizing carbon dioxide as refrigerant. Consequently, the present invention is particularly effective when applied to piston type compressors using carbon dioxide as refrigerant.

Figure 5:
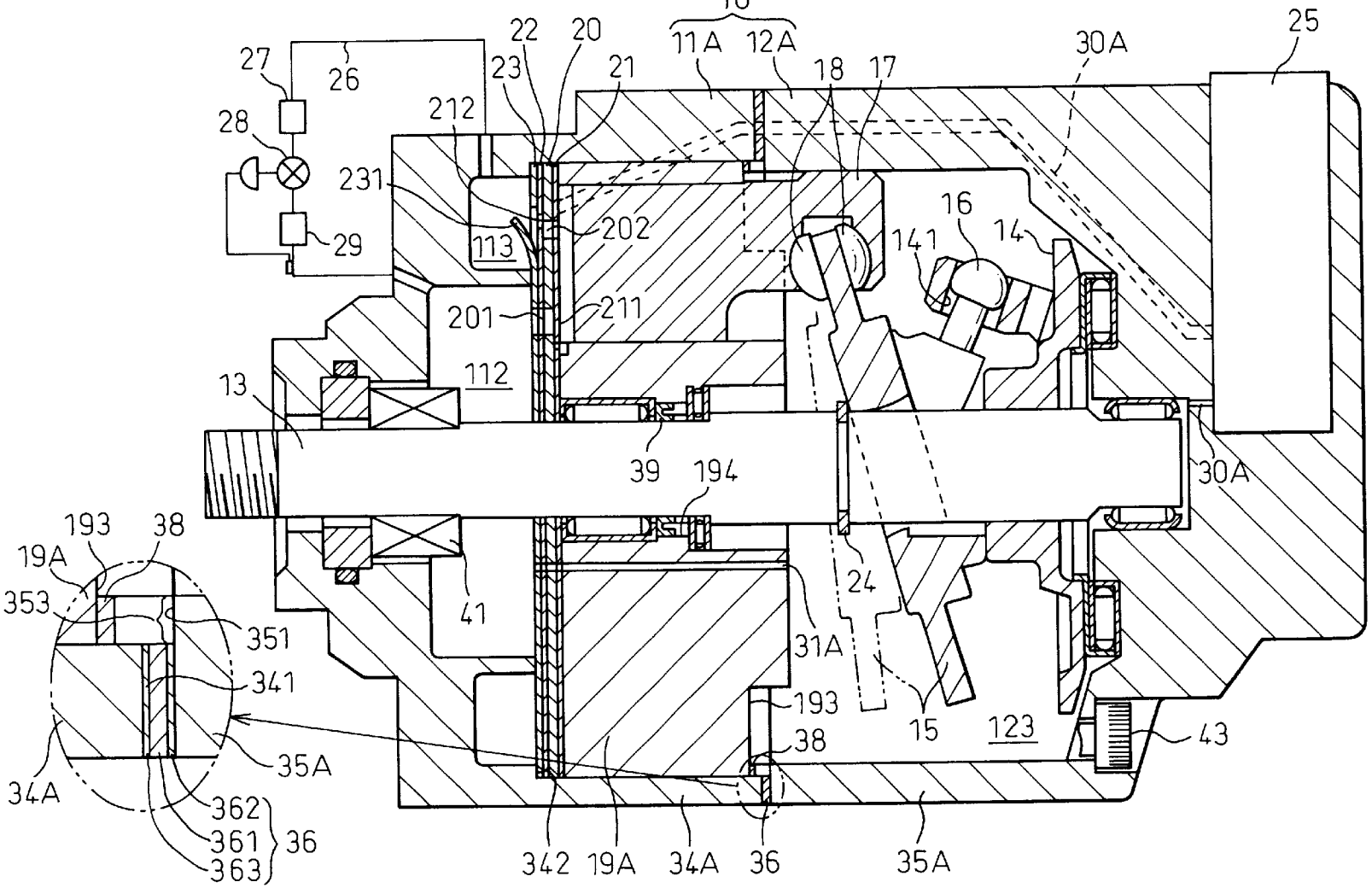

Next, referring to FIGS. 5 and 6, a second embodiment of the present invention will be described. Like reference numerals denote constituent components which are alike those described in the first embodiment.

In this embodiment, a suction chamber 112 and a discharge chamber 113 are formed in a front housing 11A, and a valve plate 20, valve forming plates 21, 22, a retainer forming plate 23 and a cylinder 19A are fitted in the front housing 11A. A difference in level 342 formed on an inner circumferential side of a circumferential wall 34A of the front housing 11 defines the position of the cylinder 19A relative to the front housing 11A.

A pressure control chamber 123 is formed in a rear housing 12A, and a rotating shaft 13 is rotatably supported on the cylinder 19A and the rear housing 12A. The rotating shaft 13 passes through the pressure control chamber 123 and the suction chamber 112, and a shaft sealing member 39 is provided in a shaft hole 194 in the cylinder 19A through which the rotating shaft 13 is allowed to pass. The shaft sealing member 39 prevents leakage of refrigerant past the circumferential surface of the rotating shaft 13 between the pressure control chamber 123 and the suction chamber 112. Reference numeral 30A denotes a pressure supply passage for connecting the discharge chamber 113 with the pressure control chamber 123, and reference numeral 31A denotes a pressure release passage for connecting the pressure control chamber 123 with the suction chamber 112.

Figure 6:
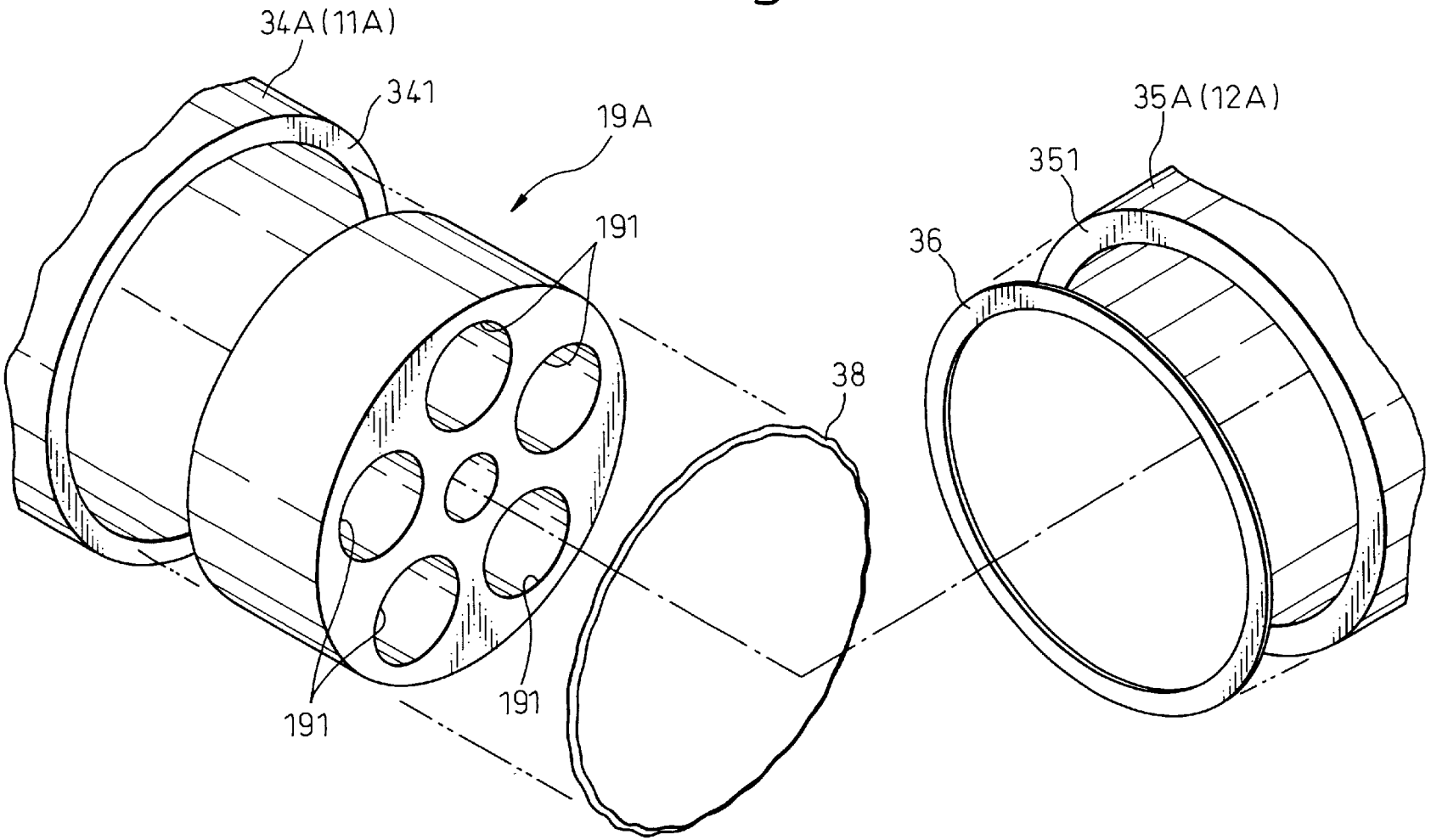
FIG. 6 is an exploded perspective view of the compressor according to the second embodiment, FIG. 7, showing a third embodiment of the present invention, is a cross-sectional side view of the entirety of a compressor with an enlarged cross-sectional side view of a main part of the compressor being incorporated therein, and FIG. 8, showing a fourth embodiment of the present invention, is a cross-sectional side view of the entirety of a compressor with an enlarged cross-sectional side view of a main part of the compressor being incorporated therein.

As shown in FIG. 6, a wave washer 38 is interposed between an end face 193 of the cylinder 19A and a difference in level 353 on an end face 351 of a circumferential wall 35A of the rear housing 12A. The wave washer 38 functions in the same manner as the coned disc spring in the first embodiment, and the cylinder 19A and the wave washer 38 are held together with the gasket 36 between the front housing 11A and the rear housing 12A in an ensured fashion.

Figure 7:
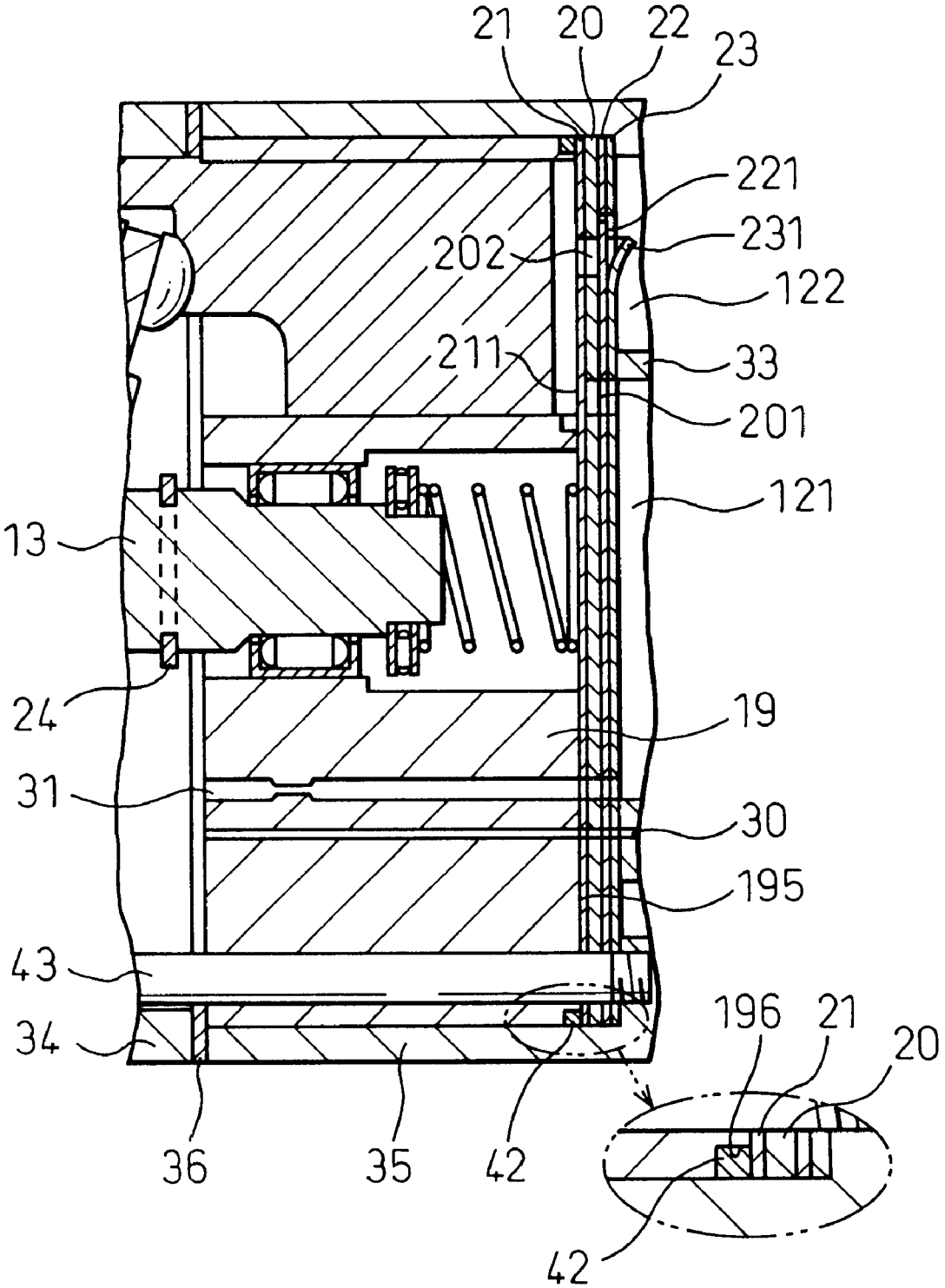

Next, referring to FIG. 7, a third embodiment of the present invention will be described. Like reference numerals denote constituent components which are alike those described in the first embodiment.

An annular groove 196 is formed in an circumferential edge of an end face 195 of a cylinder 19, and a resin gap absorbing ring 42 is interposed between a bottom of the groove 196 and a valve forming plate 21. An end face 195 of the cylinder 19 abuts against the valve forming plate 21. The thickness of the gap absorbing ring 42 when in its natural condition is greater than the depth of the groove 196, and in the state illustrated in FIG. 7, the gap absorbing ring 42 is elastically deformed and contracted in an axial direction of a rotating shaft 13. The gap absorbing ring 42 functions in the same manner as the coned disc spring 37 in the first embodiment and the wave washer 38 in the second embodiment.

Figure 8:
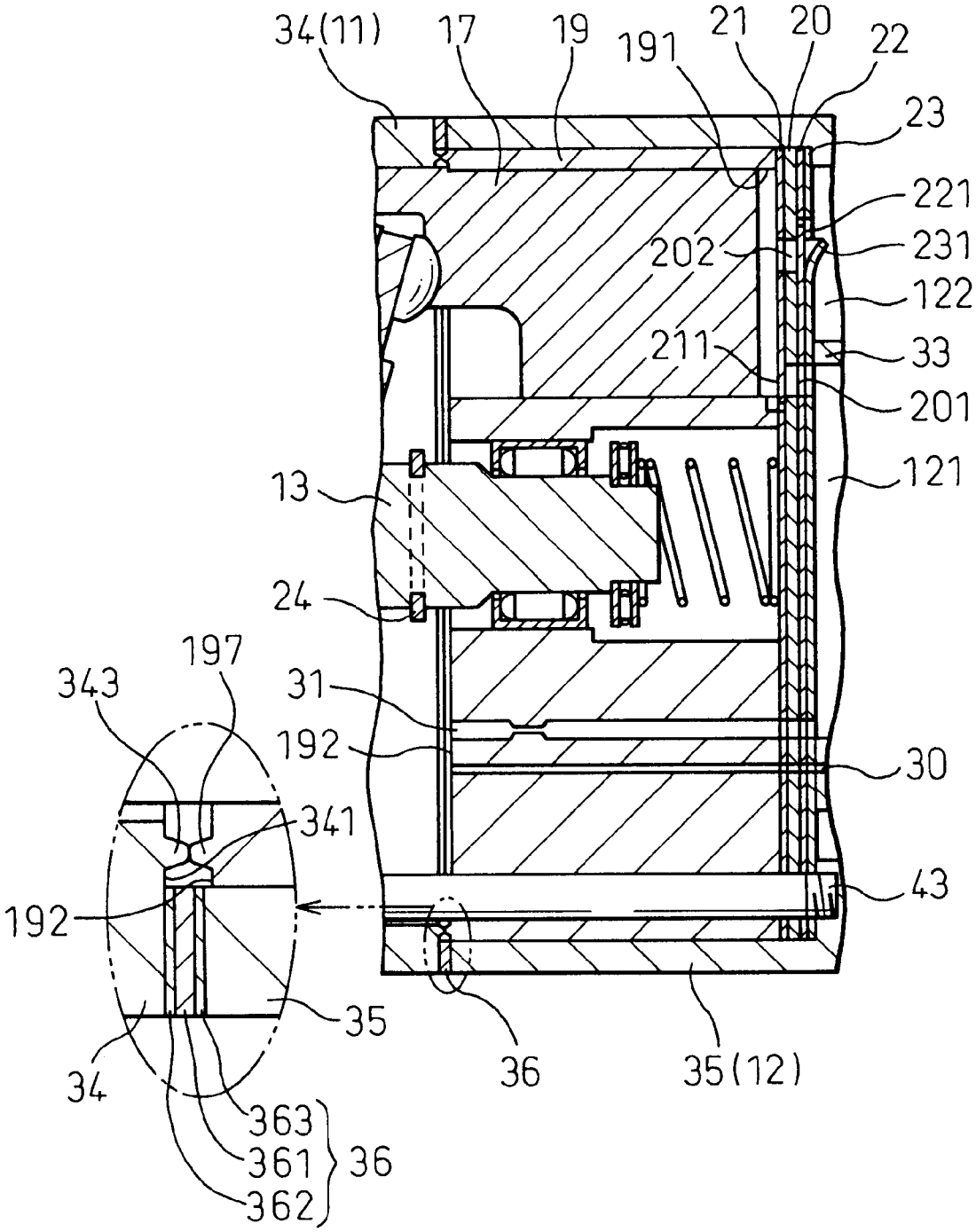

Next, referring to FIG. 8, a fourth embodiment will be described. Like reference numerals denote constituent components which are alike those described in the first embodiment.

An annular elongate projection 343 is formed on an end face 341 of a circumferential wall 34 of an aluminum front housing 11, and an elongate projection 197, which has the same shape and size as the elongate projection 343, is formed on an end face 192 of an aluminum cylinder 19. A sum of the heights of the elongate projections 343, 197 before the front housing 11 and a rear housing 12 are assembled together, is larger than a gap between the end face 192 of the cylinder 19 and an end face 351 of the rear housing 12.

In the state in which a gasket 36 is held between the end faces 341, 351, the elongate projections 343, 197 are deformed and pressed against each other. Aluminum, which is effective in reducing the weight of the front housing 11 and the cylinder 19, is a soft metal, and the elongate projections 343, 197 of the soft metal are easily deformed.

The elongate projections 343, 197 which constitute the gap absorbing body, function in the same manner as the coned disc spring 37 in the first embodiment and the wave washer 38 in the second embodiment, and it is ensured that the cylinder 19 is held together with the gasket 36 between the front housing 11 and the rear housing 12.

The following embodiments may be provided according to the present invention.

(1) A ring of soft metal such as aluminum and copper is used as the gap absorbing body.

(2) A seal ring composed only of rubber is used as the seal member.

(3) Either the elongate projection 343 or the elongate projection 197 is omitted in the fourth embodiment.

(4) A plurality of projections are arranged in the circumferential direction instead of the annular projections 343, 197 in the fourth embodiment.

(5) The present invention is applied to a fixed displacement type piston compressor.

As has been described in detail heretofore, according to the present invention, since the gap absorbing body is deformed by the first housing and the second housing so that the cylinder and the gap absorbing body are both held therebetween with the seal material being held by the first housing and the second housing, this results in a notable advantage, in that the cylinder incorporated in the total housing constituted by the first housing and the second housing and the seal material interposed between the first housing and the second housing are both held by the first housing and the second housing in an ensured fashion.

What is claimed is:

1. A piston type compressor in which pistons are accommodated in cylinder bores formed in a cylinder, in which said pistons are reciprocated through rotation of a rotating shaft so that gas is sucked into and is discharged from said cylinder bores through reciprocating motion of said pistons, and in which said cylinder is incorporated in a total housing constructed by joining a first housing and a second housing together, said piston type compressor comprising;

a seal material provided at a joint between said first housing and said second housing so as to be held by said first housing and said second housing therebetween, and a gap absorbing body interposed between said cylinder and at least one of said first housing and second housing, wherein in a state in which said seal material is held by said first housing and said second housing therebetween, said gap absorbing body is deformed by said first housing and said second housing so that said cylinder and said gap absorbing body are both held therebetween.

2. A piston type compressor according to claim 1, wherein said gap absorbing body comprises an elastic body.

3. A piston type compressor according to claim 1, wherein said gap absorbing body is formed of a soft metal.

4. A piston type compressor according to claim 1, wherein said gap absorbing body comprises a deformable projection integrally formed on at least one of said first housing and said second housing.

5. A piston type compressor according to claim 1, wherein said gap absorbing body comprises a gap absorbing ring which conforms to the annular contour of said joint which surrounds the rotating axis of said rotating shaft.

* * * * *